US007864118B2

(12) United States Patent
Shi

(10) Patent No.: US 7,864,118 B2
(45) Date of Patent: Jan. 4, 2011

(54) DUAL CIRCULARLY POLARIZED ANTENNA SYSTEM AND A METHOD OF COMMUNICATING SIGNALS BY THE ANTENNA SYSTEM

(75) Inventor: Shawn Shi, Thousand Oaks, CA (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 12/612,128

(22) Filed: Nov. 4, 2009

(65) Prior Publication Data

US 2010/0045549 A1 Feb. 25, 2010

Related U.S. Application Data

(62) Division of application No. 11/899,200, filed on Sep. 5, 2007, now Pat. No. 7,636,064.

(51) Int. Cl.
*H01Q 5/00* (2006.01)

(52) U.S. Cl. ..... 343/700 MS

(58) Field of Classification Search ..... 343/713, 343/700 MS

See application file for complete search history.

(56) References Cited

U.S. PATENT DOCUMENTS 2,081,162 A 5/1937 Alford
4,833,482 A 5/1989 Trinh et al.

(Continued)

FOREIGN PATENT DOCUMENTS

EP 1 058 339 12/2000
GB 1 529 361 10/1978

OTHER PUBLICATIONS

Johan Hendriksson, et al.: "A Circularly Polarized Traveling-Wave Chain Antenna", European Microwave Conference, 1979, 9th IEEE, Piscataway, NJ, USA, Oct. 1, 1979, pp. 174-178, XO01306731.

(Continued)

*Primary Examiner*—Rexford N Barnie
*Assistant Examiner*—Thienvu V Tran
(74) *Attorney, Agent, or Firm*—Jimmy L. Funke

(57) ABSTRACT

An antenna system and a method for communicating signals by a dual circularly polarized antenna system are provided. The antenna system includes a substantially straight microstrip segment and a plurality of substantially straight microstrip projections. The plurality of microstrip projections extend from the microstrip segment in pairs at a predetermined angle, wherein each microstrip projection of the pair of microstrip projections extends from substantially the same location on the microstrip segment. A first microstrip projection extends from the microstrip segment on a first side of the microstrip segment and a second microstrip projection extends from the microstrip segment on a second side of the microstrip segment, such that the first and second microstrip projections at least one of emit and receive circularly polarized radiation in a first direction and circularly polarized radiation in a second direction simultaneously.

8 Claims, 6 Drawing Sheets

U.S. PATENT DOCUMENTS

| | | | | |
|---|---|---|---|---|
| 5,712,643 | A | 1/1998 | Skladany | |
| 6,424,298 | B1 | 7/2002 | Nishikawa et al. | |
| 6,496,152 | B2 * | 12/2002 | Nilsson | 343/713 |
| 7,071,890 | B2 | 7/2006 | Tanaka et al. | |
| 2004/0017316 | A1 | 1/2004 | Tanaka et al. | |

OTHER PUBLICATIONS

Haskins, P.M., et al.: "Squinted-beam 'herringbone' array", Antennas And Propagation Society International Symposium, 1998, IEEE Atlanta, GA, USA Jun. 21-26, 1998, New York, NY, USA, IEEE, US, vol. 2, Jun. 21, 1998, pp. 1150-1153, XPO10292349, ISBN: 987-0-7803-4478-5.

David J. Jefferies, The Fishbone Antenna a Simple Slow Wave Structure Implementation, Jan. 2007, pp. 1-11.

* cited by examiner

DUAL CIRCULARLY POLARIZED ANTENNA SYSTEM AND A METHOD OF COMMUNICATING SIGNALS BY THE ANTENNA SYSTEM

CROSS REFERENCE TO RELATED APPLICATIONS

The present application is a divisional application of U.S. patent application Ser. No. 11/899,200 filed on Sep. 5, 2007.

TECHNICAL FIELD

The present invention generally relates to an antenna system and a method of communicating signals by the antenna system, and more particularly, to a dual circularly polarized antenna system and a method of communicating signals by the antenna system.

BACKGROUND OF THE DISCLOSURE

Wirelessly transmitted signals can be formatted in multiple ways, where the desired receiver is configured to receive the formatted signal. One example of formatting a signal is to polarize the signal, such as linear or circular polarization. Thus, the corresponding receiver typically needs an antenna that is configured to receive the signal that is polarized in a particular direction. Additionally, the antenna of the receiver can be configured to direct a beam in a particular direction in order to receive the transmitted signal.

In reference to FIG. 1, one example of a conventional antenna is a herringbone antenna, which is generally shown at reference identifier 10. Generally, the herringbone antenna 10 has a segment 12 with extensions 14 offset from one another, such that the herringbone antenna 10 is configured to receive a signal that is circularly polarized in a single direction near bore site. Thus, the herringbone antenna 10 can typically receive either right-hand circularly polarized (RHCP) signals or left-hand circularly polarized (LHCP) signals, but not both RHCP and LHCP signals at the same time. Additionally, the herringbone antenna 10 typically does not adequately receive circularly polarized signals in either direction distant from the bore sight, such that the herringbone antenna 10 does not adequately receive the signal if the herringbone antenna 10 is not substantially directly pointed at the source of the signal. Generally, if an electrical current is applied to the right end of the herringbone antenna 10, then the herringbone antenna 10 emits RHCP radiation, and if the electrical current is applied to the left end of the herringbone antenna 10, then the herringbone antenna 10 emits LHCP radiation, but the herringbone antenna 10 is not simultaneously dual circularly polarized.

With regards to FIG. 2, another example of a conventional antenna is a fishbone antenna that is generally shown at reference identifier 20. Typically, the fishbone antenna 20 has a positive electrical path 22 and a negative electrical path 24, which are substantially parallel to one another, and extensions 26 extending from a single side of both electrical paths 22,24, and is used as an end-fire antenna, where the electrical current is applied to the ends of the paths 22,24. Generally, the fishbone antenna 20 is a linearly polarized antenna. Typically, a linear polarized antenna is configured to have vertical polarization or horizontal polarization, and thus, cannot receive circularly polarized signals.

SUMMARY OF THE INVENTION

According to one aspect of the present invention, an antenna system includes a substantially straight microstrip segment and a plurality of substantially straight microstrip projections. The microstrip segment has a feed point, where an electrical current is applied to the microstrip segment at the feed point. The plurality of microstrip projections extend from the microstrip segment in pairs at a predetermined angle, wherein each microstrip projection of the pair of microstrip projections extends from substantially the same location on the microstrip segment. A first microstrip projection of the plurality of microstrip projections extends from the microstrip segment on a first side of the microstrip segment and a second microstrip projection of the plurality of microstrip projections extends from the microstrip segment on a second side of the microstrip segment, such that the first and second microstrip projections at least one of emit and receive one sense of circularly polarized radiation in a first direction and another sense of circularly polarized radiation in a second direction simultaneously.

According to another aspect of the present invention, an antenna system includes a plurality of substantially straight microstrip segments, a plurality of connectors, and a plurality of substantially straight microstrip projections. The plurality of microstrip segments each have a feed point distant from the ends of the microstrip segment. At least one connector of the plurality of connectors electrically connects the plurality of microstrip segments, wherein one connector connects the microstrip segment at the feed point. The plurality of microstrip projections extend from the microstrip segment in pairs at a predetermined angle, wherein each microstrip projection of the pair of the microstrip projections extends from substantially the same location on the microstrip segment. A first microstrip projection of the plurality of microstrip projections extends from the microstrip segment on a first side of the microstrip segment and a second microstrip projection of the plurality of microstrip projections extends from the microstrip segment on a second side of the microstrip segment, such that the first and second microstrip projections at least one of emit and receive right-hand circularly polarized (RHCP) radiation in one direction and left-hand circularly polarized (LHCP) radiation in another direction simultaneously.

According to yet another aspect of the present invention, a method of communicating a signal by a dual circularly polarized antenna system includes the step of providing a plurality of substantially straight microstrip segments, wherein the microstrip segments are electrically connected subarrays. The method further includes the steps of selecting a frequency, receiving circular polarization radiation in a plurality of directions from a plurality of substantially straight microstrip projections extending from each of the microstrip segments simultaneously, scanning the subarrays for a signal at the selected frequency, rotating the plurality of microstrip segments, and receiving a signal at the selected frequency based upon scanning the subarrays and the rotational position of the plurality of microstrip segments.

These and other features, advantages and objects of the present invention will be further understood and appreciated by those skilled in the art by reference to the following specification, claims and appended drawings.

BRIEF DESCRIPTION OF THE DRAWINGS

The present invention will now be described, by way of example, with reference to the accompanying drawings, in which.

DESCRIPTION OF PREFERRED EMBODIMENTS

Figure 1:
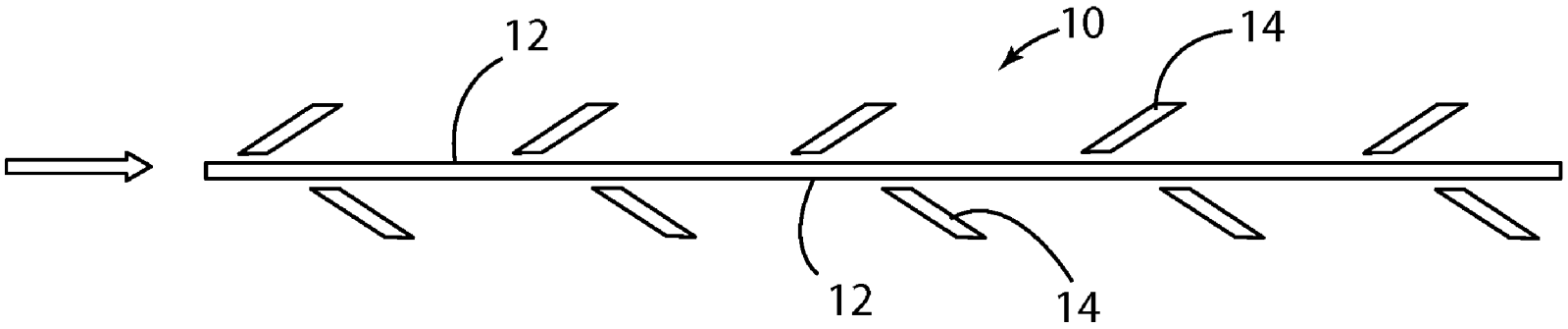
FIG. 1 PRIOR ART
FIG. 1 is a top plan view of a conventional herringbone antenna.
Figure 2:
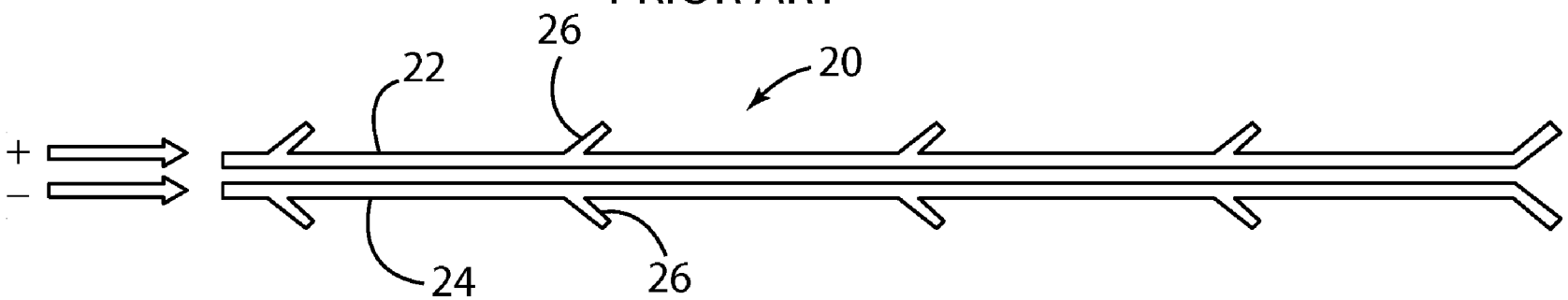
FIG. 2 PRIOR ART
FIG. 2 is a top plan view of a conventional fishbone antenna.
Figure 3:
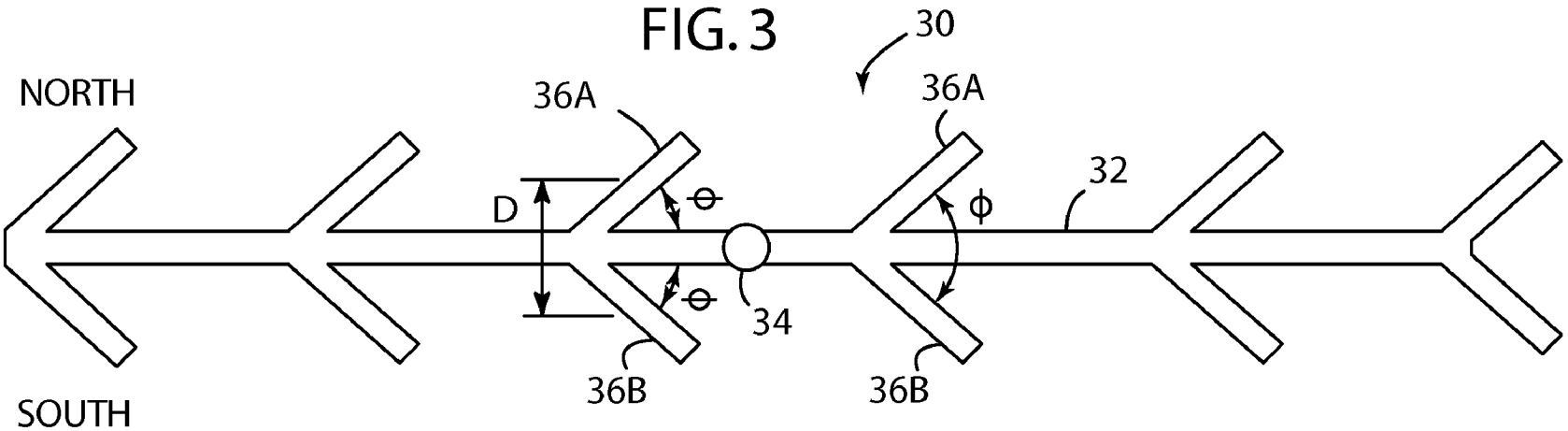
FIG. 3 is a top plan view of an antenna system, in accordance with one embodiment of the present invention.

In reference to FIG. 3, an antenna system is generally shown at reference identifier 30. The antenna system 30 includes a substantially straight microstrip segment 32 having a feed point 34, where electrical current is applied to the microstrip segment 32 at the feed point 34, according to a disclosed embodiment. According to one embodiment, the feed point 34 is distant from the ends of the microstrip segment 32, such that, the feed point 34 can be at or around a midpoint of the microstrip segment 32.

The antenna system 30 also includes a plurality of substantially straight microstrip projections that extend from the microstrip segment in pairs at a predetermined angle E. Each of the microstrip projections of the pair of the microstrip projections extends from substantially the same location on the microstrip segment 32. According to an alternate embodiment, the electrical current can be applied to the microstrip projections, such as, but not limited to, a midpoint of adjacent pairs of microstrip projections 36A,36B. Alternatively, the feed point 34 can be at the ends of the microstrip segment 32, according to one embodiment.

Figure 6:
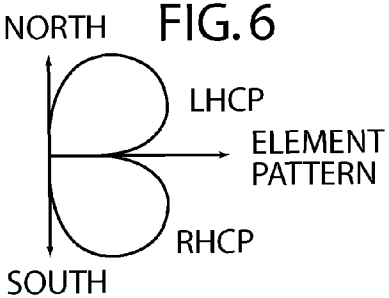
FIG. 6 is a diagram illustrating an element pattern of an antenna system, in accordance with one embodiment of the present invention.
Figure 7:
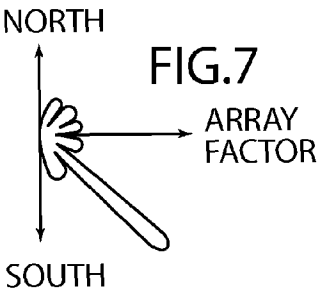
FIG. 7 is a diagram illustrating an array factor of an antenna system, in accordance with one embodiment of the present invention.

Typically, a first microstrip projection 36A of the plurality of microstrip projections extends from a first side of the microstrip segment 32, and a second microstrip projection 36B of the plurality of microstrip projections extends from a second side of the microstrip segment 32, such that the first and second microstrip projections 36A,36B emit and/or receive circularly polarized radiation in first and second directions, as described in greater detail herein. Thus, the microstrip projections 36A,36B have an element pattern (FIG. 6) with opposite sense of circular polarizations separated by direction. Additionally, the microstrip projections 36A,36B emit linearly polarized radiation at bore sight. The microstrip segment 32, feed point 34, and microstrip projections 36A,36B may be made of an electrically conductive material, and may be formed on a dielectric substrate.

By way of explanation and not limitation, the pairs of microstrip projections 36A,36B can be spaced apart by approximately one wavelength of a single signal that is transmitted or received by the antenna system 30. The predetermined angle θ between the microstrip segment 32 and each of the microstrip projections 36A,36B is approximately forty-five degrees (45°), according to one embodiment. Thus, an angle ϕ between each of the microstrip projections 36A,36B of the pair of microstrip projections can be approximately ninety degrees (90°). When the electrical current is applied to the microstrip projections 36A,36B, the radiation emitted by the microstrip projections 36A,36B is in-phase at bore sight and out-of-phase in the upper and lower directions (i.e., north and south), since midpoints of the microstrip projections 36A,36B are not overlapping and separated by a distance (D). Further, the length of the microstrip projections 36A,36B can be approximately one-half a wavelength of a signal being transmitted or received by the antenna system 30, according to one embodiment.

Figure 4:
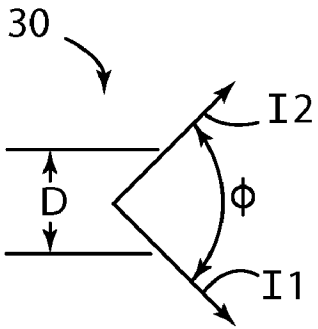
FIG. 4 is a vector diagram illustrating electrical currents propagating through microstrip projections of the antenna system of FIG. 3, in accordance with one embodiment of the present invention.

With regards to both FIGS. 3 and 4, according to one embodiment, the microstrip projections 36A,36B of the pair of the microstrip projections are symmetrical with one another. When electrical current is applied to the antenna system 30, the electrical current propagating through the first microstrip projection 36A has a first electrical current value $I_1$ and the electrical current propagating through the second microstrip projection 36B has a second electrical current value $I_2$. According to a disclosed embodiment, the electrical current values $I_1$,$I_2$ of the microstrip projections 36A,36B, respectively, are equal in magnitude and phase, and are orthogonal to one another. When the phase centers of the electrical current values $I_1$,$I_2$ are separated by the distance (D), the radiation emitted by the microstrip projections 36A, 36B is circularly polarized in opposite directions, is in-phase at bore sight, and out-of-phase off bore sight vertically, according to one embodiment.

Figure 5:
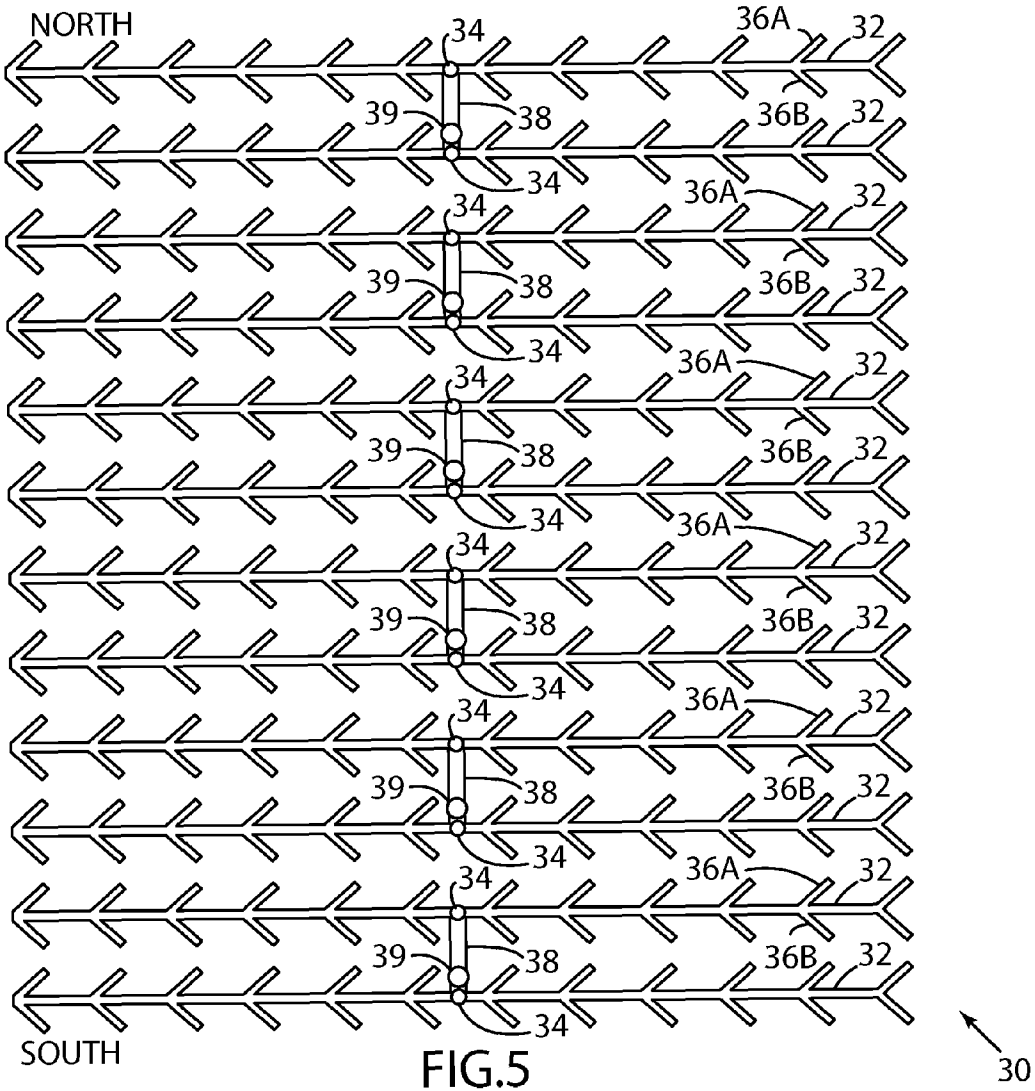
FIG. 5 is top plan view of an antenna system having a plurality of microstrip segments, in accordance with an alternate embodiment of the present invention.

According to an alternate embodiment shown in FIG. 5, the antenna system 30 includes a plurality of microstrip segments 32 electrically connected by electrical connector 38. According to a disclosed embodiment, the connector 38 electrically connects two microstrip segments 32 at the feed point 34 of each microstrip segment 32, and thus, forming a planar array of microstrip segments 32. It should be appreciated by those skilled in the art that any number of microstrip segments 32 can be electrically connected by a single or multiple electrical connectors 38 to form a planar array.

According to one embodiment, an electrical current is applied to the connector 38 at a feed point 39 on the connector 38 that is distant from the midpoint of the connector 38. For purposes of explanation and not limitation, the feed point 39 can be a quarter wavelength offset from the midpoint of the connector 38, which typically results in a null of the emitted radiation pattern at bore sight, according to one embodiment. According to an alternate embodiment, the feed point 39 can be at the midpoint of the connector 38, which typically results in no nulls in the emitted radiation pattern. It should be appreciated by those skilled in the art that the feed point 39 can be located at other locations on the connector 38, resulting in nulls in the emitted radiation pattern.

The electrical current passes through the connector 38 and passes to the microstrip segments 32 of the feed points 34. Thus, first and second microstrip projections 36A,36B can be fed an electrical current in-phase, but the radiation emitted by the first and second microstrip projections 36A,36B on the first microstrip segment 32 are out-of-phase from the radiation emitted by the first and second microstrip projections 36A,36B on the second microstrip segment 32 that are connected by the connector 38 forming two radiation lobes, such as right-hand circularly polarized (RHCP) radiation in north and left-hand circularly polarization (LHCP) radiation in south. The vertically out-of-phase emitted radiation is from the electrical current being applied at feed point 39 that is offset or distant from the midpoint of the connector 38. According to one embodiment, zero radiation is emitted at bore sight when electrical current is applied to feed point 39, such that, maximum radiation is emitted off bore sight.

In reference to FIGS. 5-8, for purposes of explanation and not limitation, the radiation emitted by the first microstrip projection 36A lags in phase behind the radiation emitted by the second microstrip projection 36B on the south side due to the longer path of the propagating wave. This typically results in emitted radiation being RHCP. On the north side of the antenna system 30, the radiation emitted by the first microstrip projection 36A leads in phase over the radiation emitted by the second microstrip projection 36B due to the shorter propagating path of the electromagnetic wave. This typically results in the emitted radiation being LHCP. Thus, the element pattern (FIG. 6) generated by applying the electrical current to feed point 39 is dual circularly polarized, such that RHCP radiation is emitted on the south side and LHCP radiation is emitted on the north side and both the RHCP and LHCP may be emitted simultaneously.

According to a disclosed embodiment, each pair of microstrip segments 32 that are connected by the connector 38 forms a subarray. It should be appreciated by those skilled in the art that any number of microstrip segments 32 can be connected to form a subarray, and that any number of subarrays can be used to form an array. The subarrays can be electronically scanned, such that it can be determined if a signal is being received. When a subarray is selected, an array factor (FIG. 7) can be created. The orientation of the array factor is dependent upon the direction that the selected array is pointed. Thus, the total pattern (FIG. 8) of the array is based upon the selected subarray and the orientation of the array, such as, whether the RHCP and LHCP portions of the array are directed to the north or south.

For purposes of explanation and not limitation, the subarrays can be scanned by applying a different electrical current to each subarray at the feed point 39, according to one embodiment. The electrical current can differ by changing the magnitude and/or phase of the electrical current, according to a disclosed embodiment.

Figure 9:
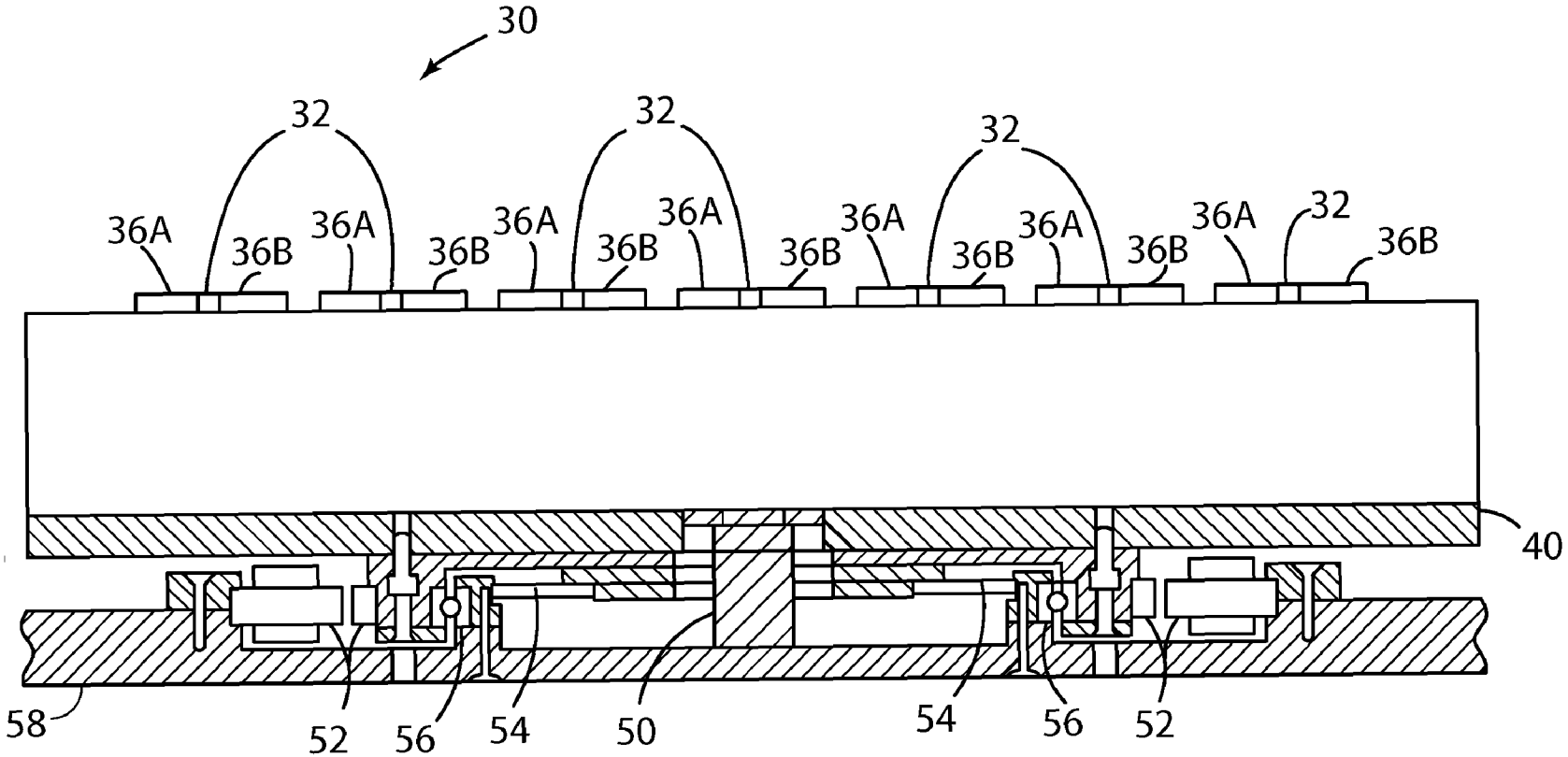
FIG. 9 is a cross-sectional front plan view of an antenna system, wherein microstrip segments are connected to a rotatable surface, in accordance with one embodiment of the present invention.

According to one embodiment, as shown in FIG. 9, the antenna system 30 can be connected to a rotatable surface 40 for altering the beam direction or the orientation of the array factor to a desired direction. A controller can be used to command an actuator (e.g., electric motor) to mechanically rotate the rotatable surface 40 in order to control the orientation of the array factor. Thus, if the microstrip projections 36A,36B are emitting LHCP radiation and are directed towards the north, then the actuator can rotate the rotatable surface 40, such that the microstrip projections 36A,36B are emitting LHCP radiation to the south.

According to a disclosed embodiment, the rotatable surface 40, is actuated or rotated by a rotary joint 50 and motor 52. An encoder 54 can be used to determine the rotational location of the rotatable surface and the microstrip segments 32. Additionally, bearings 56 can be used for ease in rotating the rotatable surface 40.

Figure 10:
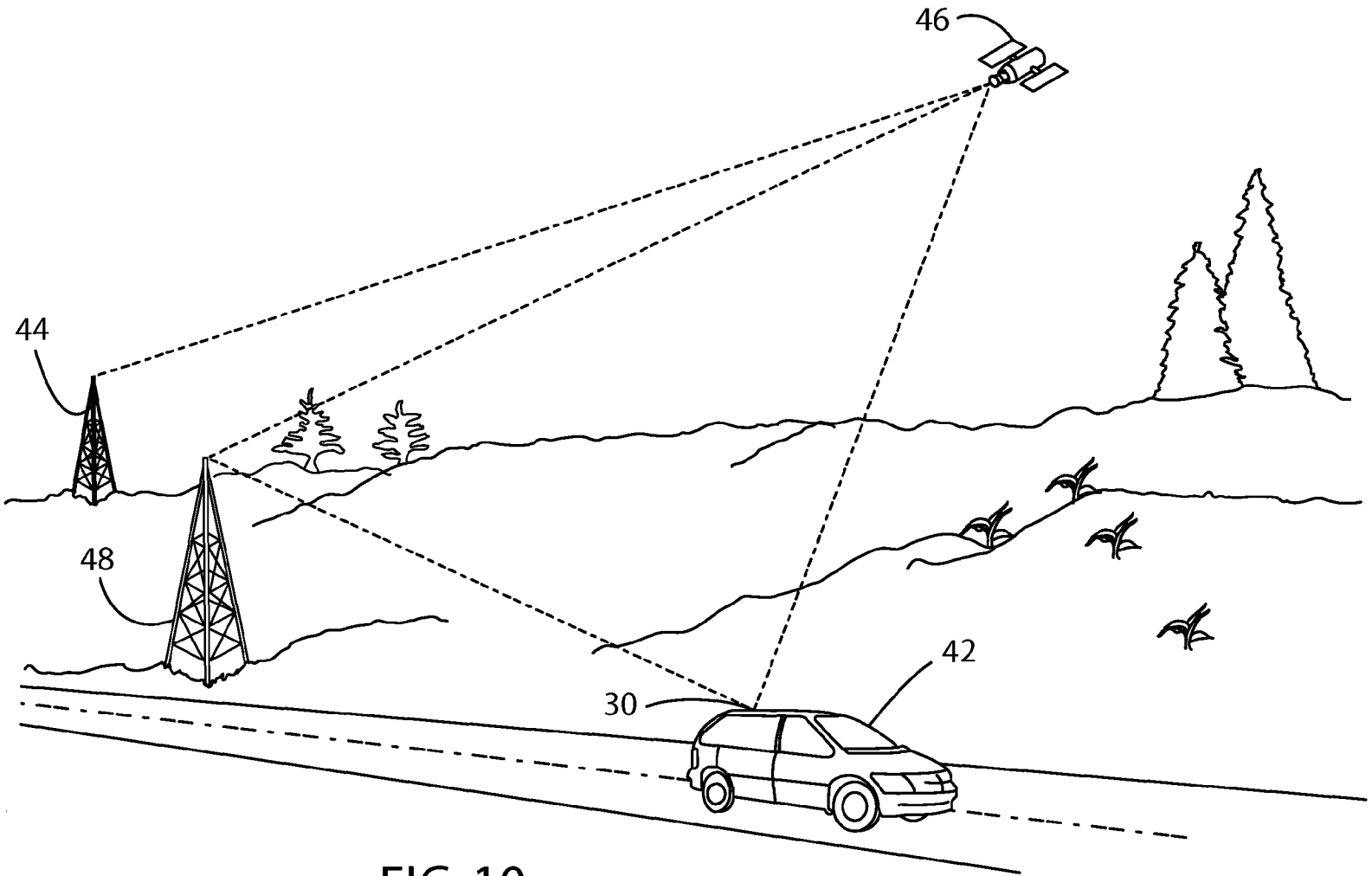
FIG. 10 is an environmental view of a communication system including an antenna system, in accordance with one embodiment of the present invention.

In reference to FIG. 10, by way of explanation and not limitation, the antenna system 30 can be used with a vehicle 42, such that the antenna system 30 receives signals from a satellite 46, as described in U.S. Provisional Patent Application No. 60/911,646 entitled "SYSTEM AND METHOD FOR TRANSMITTING AND RECEIVING SATELLITE TELEVISION SIGNALS," which is hereby incorporated by reference herein. According to one embodiment, the antenna system 30 is embedded in a roofline of the vehicle 42. The antenna system 30 receives a signal transmitted by a transmitter 44, where the signal is received and re-transmitted by the satellite 46 as a satellite radio frequency (RF) signal. Thus, the antenna system 30 is used with a direct broadcast satellite (DBS) system. Typically, the satellite 46 is a geostationary (GEO) satellite. Alternatively, a terrestrial repeater 48 receives the signal from the satellite 46 and re-transmits the signal as an RF signal, which is received by the antenna system 30.

Figure 8:
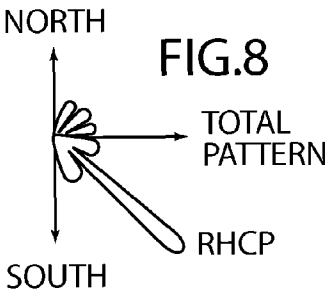
FIG. 8 is a diagram illustrating an antenna pattern of an antenna system, in accordance with one embodiment of the present invention.

The signal being received by the antenna system 30 is monitored, such that, the arrays of microstrip segments 32 are electronically scanned. Thus, depending upon which signal being transmitted by the transmitter 44 and satellite 46 wants to be received, is dependent upon the array of microstrip segments 32 selected. The rotatable surface 40 can then be actuated in order to mechanically re-direct the selected array. When each array pattern (FIG. 7) is combined with the element pattern (FIG. 6), the antenna beam is steered (FIG. 8).

According to a disclosed embodiment, the satellite 46 is a GEO satellite, such that if vehicle 42 is operating in North America, the antenna beam should be substantially directed towards the south in order to receive the signal re-transmitted from the satellite 46. Thus, if the signal is being transmitted as a RHCP signal, and the antenna system 30 is positioned so that the RHCP element pattern of the antenna system 30 is substantially directed towards the north, the controller actuates or rotates the rotatable surface 40 so that the RHCP element pattern of the antenna system 30 is substantially directed towards the south, such that the selected array pattern is mechanically re-directed. As the vehicle 42 is mobile and changing directions, the desired beam of the antenna system 30 can be substantially directed towards the south in order to receive the desired signal from the satellite 46, according to one embodiment. Additionally, since the plurality of microstrip projections are angled in order to steer the beam according to the predetermined angle, the antenna system 30 can be flat or embedded in the roof line of the vehicle 42 while steering the antenna beam substantially south towards the satellite 46.

Figure 11:
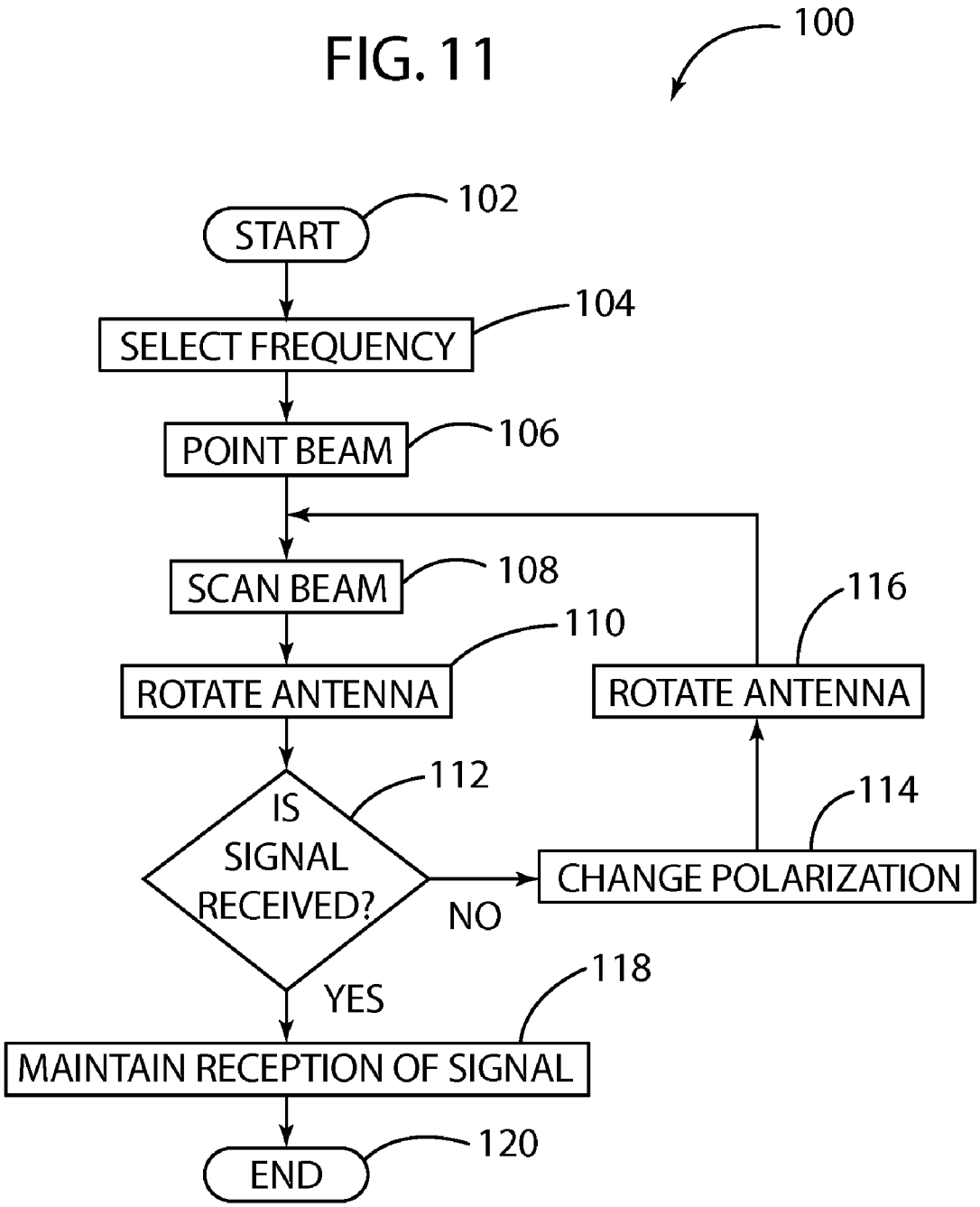
FIG. 11 is a flow chart illustrating a method of communicating signals with an antenna system, in accordance with one embodiment of the present invention.

In reference to FIGS. 3-11, a method of communicating signals is generally shown in FIG. 11 at reference identifier 100. The method 100 starts at step 102, and proceeds to step 104, where a frequency is selected. According to one embodiment, a frequency is selected based upon a provided channel, which is currently broadcasting the desired programming. At step 106, the antenna beam is pointed in a particular direction. According to one embodiment, the beam is electronically pointed in elevation to a side of one of the microstrip projections 36A,36B, depending upon the selected frequency.

At step 108, the beam is scanned. According to one embodiment, the beam is electronically scanned at elevation to determine if the signal is being received. According to a disclosed embodiment, the beam is scanned by applying different electrical currents to the subarrays. The antenna is rotated at step 110. According to a disclosed embodiment, the microstrip segments 32 are rotated by the rotatable surface 40 in order to point the beam towards the south.

At decision step 112, it is determined if the signal at the selected frequency is being received. If it is determined at decision step 112 that the signal is not being received, then the method 100 proceeds to step 114, where the antenna system 30 changes the direction of the circularly polarized radiation that is being received by pointing the beam in elevation to the side of the opposite microstrip projection 36A,36B. At step 116, the antenna is rotated. According to a disclosed embodiment, the microstrip segments 32 are rotated in order for the beam to be pointed towards the south.

However, if it is determined at decision step 112 that the signal is being received, then the method 100 proceeds to step 118, where reception of the signal is maintained. According to one embodiment, when the antenna system 30 is used with a vehicle 42, the antenna can continuously be rotated in order for the antenna to be pointing in the desired direction to continue to receive the selected frequency. The method then ends at step 120.

According to one embodiment, the antenna system 30 is a passive system, such that the antenna system 30 can both transmit and receive signals. It should be appreciated by those skilled in the art that the above description of the antenna system 30 is applicable when the antenna system 30 is configured to transmit and/or receive signals. Thus, when the electrical current is applied, the plurality of microstrip projections emit circularly polarization in a plurality of directions simultaneously, and when the antenna system 30 is receiving signals, the plurality of microstrip projections receive circularly polarized radiation in a plurality of directions simultaneously.

Advantageously, the antenna system 30 is dual circularly polarized in two different directions, which does not require any switching mechanisms, such as an RF switch, in order to alter the polarization. Instead, the antenna system 30 can change polarizations by electronically scanning the array beam in elevation to the opposite side of the antenna system 30 and rotating the microstrip segments 32. Since the antenna system 30 is a dual circularly polarized antenna, the antenna system 30 is configured to receive and/or transmit signals that typically cannot be received and/or transmitted by a single polarized antenna. Additionally, the rotatable surface 40 can position the antenna system 30 in the desired direction in order to direct the antenna beam towards the satellite 46 in order for the antenna to receive the desired signal. Further, since the plurality of microstrip projections form pairs, wherein the pair of microstrip projections 36A,36B extend from the same microstrip segment 32, the antenna system 30 is more compact and can have a single feed point for electrical current, rather then having separate paths for each set of extensions that extend in a particular direction.

The above description is considered that of preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

The invention claimed is:

1. A method of communicating a signal by a dual circularly polarized antenna system, said method comprising the steps of:

providing a plurality of microstrip segments including a plurality of microstrip projections extending from each of said plurality of microstrip segments, wherein said microstrip segments are electrically connected forming subarrays;

selecting a frequency;

simultaneously receiving circularly polarized radiation from a plurality of directions from the plurality of microstrip projections;

scanning said subarrays for a signal at said selected frequency;

rotating said plurality of microstrip segments to enhance reception of said signal at said selected frequency; and receiving said signal at said selected frequency based upon the step of scanning said subarrays and the step of rotating said plurality of microstrip segments, wherein the step of providing the plurality of microstrip segments further include each microstrip segment in the plurality of microstrip segments being substantially straight and the plurality of microstrip projections comprising a plurality of pairs of microstrip projections, and each pair of microstrip projections in the plurality of pairs of microstrip projections connect at a point along each microstrip segment and extend out from the point of each microstrip segment.

2. The method of claim 1, wherein the dual circularly polarized antenna system communicates an emitted signal, said emitted signal being communicated by the steps of, applying an electrical current to said plurality of microstrip segments; and simultaneously emitting said circularly polarized radiation in said plurality of directions from the plurality of microstrip projections.

3. The method of claim 1, wherein the step of rotating said plurality of microstrip segments further includes said plurality of microstrip segments being connected with a rotatable surface disposed in a roof of a vehicle, said plurality of microstrip segments being rotated by movement of the rotatable surface, and the movement of the rotatable surface being independent from movement of the vehicle.

4. The method of claim 1, wherein said circularly polarized radiation in a plurality of directions comprises right-hand circularly polarized (RHCP) radiation and left-hand circularly polarized (LHCP) radiation.

5. The method of claim 1, wherein the step of providing the plurality of microstrip segments further includes each microstrip projection in the pair of microstrip projections being substantially straight.

6. The method of claim 1, wherein the step of providing the plurality of microstrip segments further includes the plurality of microstrip segments being formed on a generally planar surface.

7. The method of claim 6, wherein each microstrip segment is in a generally parallel, spaced relationship with other microstrip segments in the plurality of microstrip segments formed on the planar surface.

8. The method of claim 1, wherein the plurality of microstrip segments are formed in a roof of a vehicle, and the plurality of microstrip segments are contiguously adjacent with a roof line of the roof of the vehicle.

* * * * *